United States Patent [19]

Krickovich

[11] 4,341,285

[45] Jul. 27, 1982

[54] EMERGENCY ESCAPE DEVICE

[76] Inventor: Eli G. Krickovich, P.O. Box 106, Clinton, Iowa 52732

[21] Appl. No.: 221,493

[22] Filed: Dec. 30, 1980

[51] Int. Cl.[3] ..... A62B 1/14; A62B 1/20

[52] U.S. Cl. ..... 182/6; 188/65.4

[58] Field of Search ..... 182/5, 6, 7, 3; 188/65.4, 65.5, 65.3, 65.2, 65.1

[56] References Cited

U.S. PATENT DOCUMENTS

| | | | |
|---|---|---|---|
| 290,197 | 12/1883 | Allinder | 182/5 |
| 960,510 | 6/1910 | Cooper | 182/6 |
| 1,103,849 | 7/1914 | Stenborg | 182/5 |

*Primary Examiner*—Reinaldo P. Machado

[57] ABSTRACT

An elongated emergency escape rope, extending from an elevated position to the surface of the earth, is helically wound through guides on the legs of a U-shaped tubular frame having its legs horizontally disposed in a vertical plane in a manner to permit controlled descent of the frame when in operation. A leg harness, having thigh engaging loops, is connected at its respective end portions to respective ends of the upper frame leg and a waist support rope is affixed at one end to the upper frame leg and adjustably secured at its other end to the other end of the frame leg for holding a person safely to this device when suspended during an escape.

2 Claims, 3 Drawing Figures

EMERGENCY ESCAPE DEVICE

CROSS REFERENCE TO RELATED APPLICATION

This application is a continuation-in-part of an application filed in the United States Patent And Trademark Office on Dec. 11, 1980 under Ser. No. 215,349.

BACKGROUND OF THE INVENTION

1. Field of the Invention

This invention relates to a portable emergency escape device which would be used in an emergency to lower oneself to the ground when trapped high in a building or other structure.

Currently, hardly no one who lives or engages in activity on the second or higher floor in a building or other place, keeps a rope, a rope ladder or other equipment on hand for an emergency escape as it is not practicable. For example, not many persons could use a rope successfully for lowering themselves to the ground. Keeping a rope ladder for an emergency escape would constitute too much bulk when it is rolled into a bundle for storage. With my emergency escape apparatus, the cost, storage area required, expediency of operation, etc., makes it feasible to keep this unit on hand in high places as emergency exits can be rendered unusable by fire, etc.

2. Description of the Prior Art

During a fire or other emergency, it is customary to remove people trapped high in buildings with a long hydraulic ladder mounted on a fire truck. Sometimes a net is employed for people to jump in. However, there are many cases when the firemen are too late or their equipment isn't adequate for making a rescue thus the people who are unable to escape either burn, suffocate or jump to their death. These people could have been saved if they had my invention.

Current invention is distinctive due to the small size, light construction and simplicity which makes it expedient to operate.

The need for this concept is very great as there are innumerous high buildings in every city which can become traps during a fire or other emergency even though their safety exits appear adequate.

I do not know of any patents disclosing my invention.

SUMMARY OF THE INVENTION

A generally U-shaped frame, having parallel unequal length legs, is disposed in a generally vertical plane with the legs horizontal, when in use, with the longer leg disposed upwardly. An intermediate portion of an elongated escape rope capable of extending to the surface of the earth after being secured at one end to a fixed object at an elevated position, is helically wound, intermediate its ends, around one end portion of the longer leg of the frame through loop guides secured thereto. The escape rope is extended to and removably wound helically around the other leg of the frame between upstanding guides thereon. A weight is secured to the depending end of the rope in plumb bob fashion. A U-shaped leg harness, having thigh receiving loop-like openings integrally secured to its bight portion, is attached at its respective ends to loops formed on the respective ends of the upper frame leg. A waist supporting rope is secured at one end to one of the upper frame leg loops and adjustably tied to the loop at the opposite end of the upper frame leg.

The principal object of this invention is to provide an apparatus operatively secured to an elongated escape rope to functionally make it possible for almost any trapped person to lower himself quickly to the ground from a building of any height in an emergency.

DESCRIPTION OF THE PREFERRED EMBODIMENT

Figure 1:
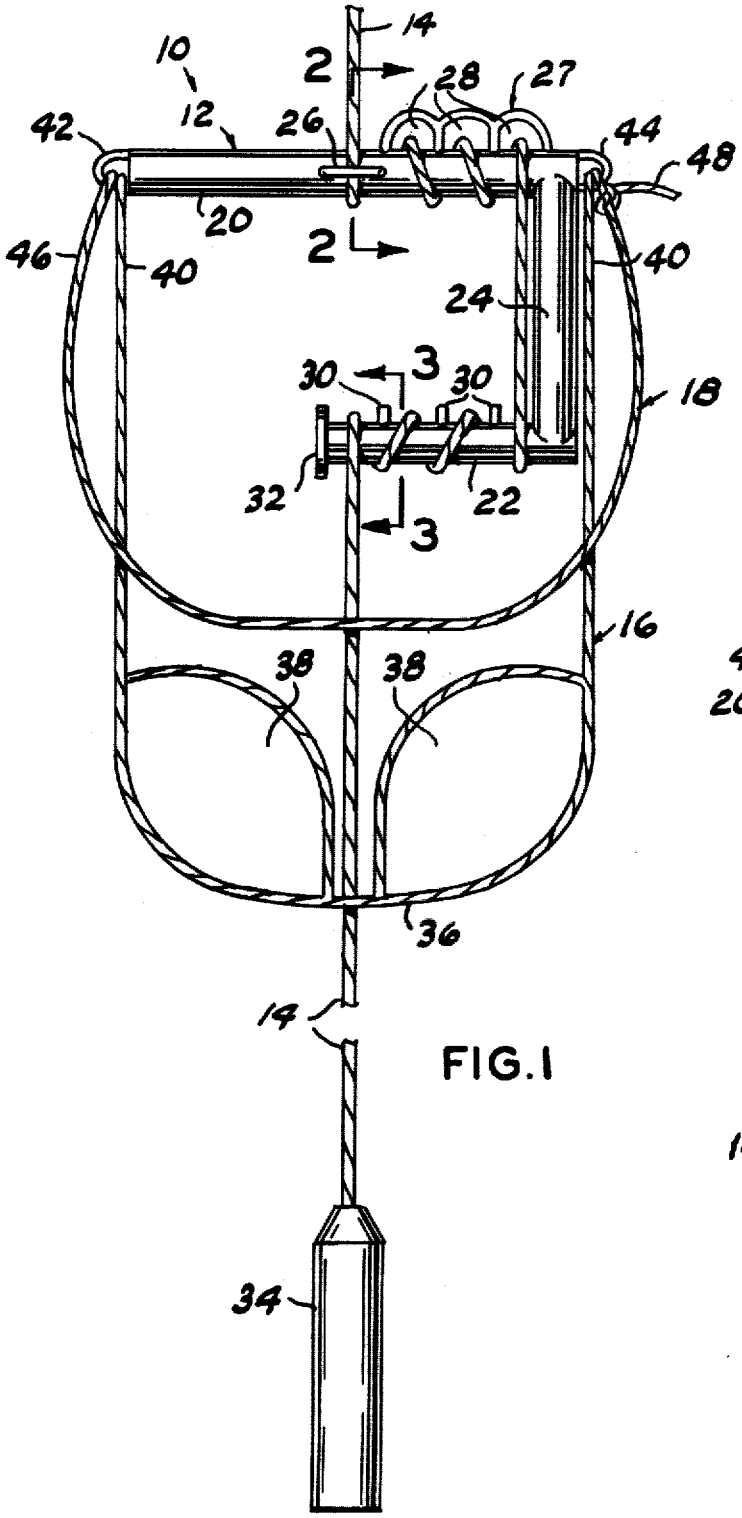
FIG. 1 is a fragmentary elevational view.
Figure 2:
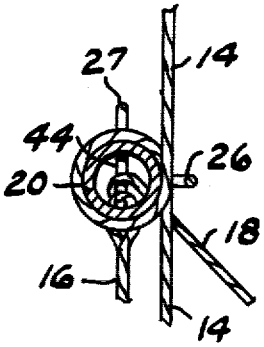
FIGS. 2 and 3 are vertical cross sectional views, to a larger scale, taken substantially along the lines 2—2 and 3—3 of FIG. 1.
Figure 3:
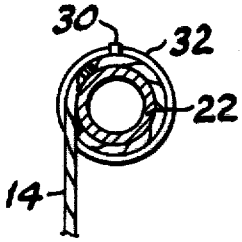

Like characters of reference designate like parts in those figures of the drawings in which they occur.

In the drawings:

The reference numeral 10 indicates the device, as a whole, which is planar in general configuration.

The device 10 comprises a frame 12, an elongated escape rope 14, a leg harness and seat 16 and a waist support 18.

The size of this unit would be according to desired need. It can be made small enough to be pertinent for travelers to carry it in their traveling case or garment pocket. A very small size Nylon rope can be used for the leg harness, waist support and for the escape rope, however, belting material or bigger rope, not shown, can be used except for the escape rope. This latter feature may be desired by persons occupying a structure on a permanent basis.

The frame 12 is U-shaped in general configuration, preferably formed from tubular material, such as pipe, characterized by a longer upwardly disposed leg 20 and a shorter leg 22 substantially one-half the length of the leg 20 with the legs being rigidly joined together in parallel spaced relation by a bight portion 24. Medially its ends, the upper leg 20 is provided with a laterally projecting rope guide 26. Between the rope 26 and its connection with the bight portion 24, the upper surface of the upper leg 20 is provided with a longitudinally extending rod-like rope guide 27 forming a series, three in the example shown, of rope guide openings 28.

An intermediate portion of the escape rope 14 is entrained through the rope guide 26 and helically wound around the frame leg 20 through the openings 28 and extended downwardly to the lower frame leg 22 to where it is similarly helically wound a plurality of times around the leg 22 between a plurality of upstanding lugs 30, each having a length at least equal to the diameter of the rope 14.

The free end of the lower frame leg 22 is provided with an annular outstanding rope guide 32 projecting radially outward from the circumference of the lower leg a distance at least equal to the diameter of the escape rope 14. The depending end portion of the rope 14 extends to or a point near the surface of the earth and since a Nylon rope capable of supporting 400 pounds would be very small, it is secured to a cylindrical weight 34 to minimize wind currents blowing, whipping or entangling its depending end portion.

The leg harness 16 is generally U-shaped, as viewed in FIG. 1, having its bight portion 36, provided with a pair of integrally connected thigh encircling portions forming openings 38 for the purposes presently explained.

The respective end portions 40 of the leg harness 16 are secured to rod-like loop forming members 42 and 44 attached to the respective ends of the frame leg 20.

The waist support rope 18, is secured at one end to the loop 42 of the frame upper leg 20 and its other end portion 48 is adjustably tied to the other frame leg loop 44.

Operation

The subject device 10 would be kept in a conventient place and would be ready for immediate use. The box containing it would have instructions printed on it. Persons occupying the area frequently would be instructed how to use it. The escape rope 14, with predetermined number of turns around frame leg 20, which would be used for everyone, would be more than long enough for reaching the ground. In case more rope is needed for tying the top end of it to something secure, it would be pulled through at the top, frame leg 20, where it goes through the rope guide 26. After the rope 14 is tied, the operator would fasten the leg harness on himself by placing his legs through each leg opening 38 and secure himself to the seat by placing the waist rope 18 around the waist and fastening the loose end of it to frame leg loop 44. The waist rope 18 is adjustable for fitting any size person. Having secured the leg harness 16 and waist rope 18 to himself, the operator would loop the rope 14 around frame leg 22 the number of times indicated in the instructions in accordance with his weight and tie it on the end of frame leg 22. This will hold him in a stop position without grasping the rope 14 while getting in a descent position. In order to lower himself, the operator would untie the rope from the frame leg 22 and remove as many turns of rope 14 on frame leg 22 as is necessary for an expedient exit. As the leg 22 is free at one end, the operator can easily apply or remove turns of rope 14 on it for regulating the speed or for stopping and tying it. There will be enough room below frame leg 22 for handling and paying out the rope 14 with both hands. Holding on to the rope 14, coupled with the support of the waist rope 18, would enable a person to maintain good balance. When a person is lowering himself with this apparatus, he would face the building, therefore, his shoes would rub against the building thereby holding him away from the side of the building which makes it ideal. An incapacitated person can be secured to this device and lowered by someone operating the escape rope from the ground. As a safety precaution for anyone using this apparatus, somebody on the ground can hold the escape rope in his hands so that he would be ready to brake it in case the descending person loses control of it. For avoiding entanglement and rubbing of the rope against itself, rope guides 26 and 27, including 30 and 32 on frame legs 20 and 22, respectively, effect this thus insuring a desired speed of descent without delay or mishap.

Upon reaching the ground, the device 10 can be pulled up for lowering another person and the cycle of operation repeated until everyone has been lowered.

Obviously the invention is susceptible to changes or alterations without defeating its practicability. Therefore, I do not with to be confined to the preferred embodiment shown in the drawings and described herein.

I claim:

1. An emergency escape device, comprising;

a generally U-shaped frame disposed in a vertical plane when in use and including at least one horizontally disposed tubular leg having spaced-apart rope guides on its periphery and having a closed loop at its respective ends;

an elongated escape rope capable of extending from an elevated position to the surface of the earth and being helically wound, intermediate its ends, around said frame leg through said rope guides;

a flexible leg harness secured in depending relation to said closed loops; and, a stabilizing weight secured to the depending end portion of said escape rope.

2. The escape device according to claim 1 and further including:

a flexible waist supporting element secured at one end portion to one said closed loop and releasably secured at its other end portion to the other said closed loop.

* * * * *